US009919901B2

(12) United States Patent
Savaresi et al.

(10) Patent No.: US 9,919,901 B2
(45) Date of Patent: Mar. 20, 2018

(54) DEVICE AND A PROCESS FOR CONTROLLING A SWINGING OF A LOAD SUSPENDED FROM A LIFTING APPARATUS

(71) Applicant: VINATI S.R.L., Nave (BS) (IT)

(72) Inventors: Sergio M. Savaresi, Cremona (IT); Felice Vinati, Nave (IT); Samuele Vinati, Nave (IT); Matteo Vinati, Nave (IT); Mariachiara Vinati, Nave (IT); Giacomo Vinati, Nave (IT)

(73) Assignee: VINATI S.R.L., Nave (BS) (IT)

( * ) Notice: Subject to any disclaimer, the term of this patent is extended or adjusted under 35 U.S.C. 154(b) by 85 days.

(21) Appl. No.: 15/038,729

(22) PCT Filed: Nov. 6, 2014

(86) PCT No.: PCT/EP2014/073905
§ 371 (c)(1),
(2) Date: May 23, 2016

(87) PCT Pub. No.: WO2015/074886
PCT Pub. Date: May 28, 2015

(65) Prior Publication Data

US 2016/0362280 A1 Dec. 15, 2016

(30) Foreign Application Priority Data

Nov. 25, 2013 (IT) ..... MI2013A1958

(51) Int. Cl.
*B66C 13/06* (2006.01)
*B66C 13/30* (2006.01)
*B66C 17/00* (2006.01)

(52) U.S. Cl.
CPC ..... *B66C 13/063* (2013.01); *B66C 13/30* (2013.01); *B66C 17/00* (2013.01)

(58) Field of Classification Search
CPC ..... B66C 13/063; B66C 13/30; B66C 17/00
See application file for complete search history.

(56) References Cited

U.S. PATENT DOCUMENTS 5,490,601 A 2/1996 Heissat et al.
5,785,191 A * 7/1998 Feddema ..... B66C 13/063 212/275

(Continued)

FOREIGN PATENT DOCUMENTS

DE 4238795 A1 7/1993
EP 2246287 11/2010

(Continued)

OTHER PUBLICATIONS

International Search Report for International Application No. PCT/EP2014/073905 filed Nov. 6, 2014 on behalf of Vinati S.R.L. dated Jan. 26, 2015.

(Continued)

*Primary Examiner* — Michael J Zanelli
(74) *Attorney, Agent, or Firm* — Steinfl + Bruno LLP

(57) ABSTRACT

A device for controlling a swinging of a load suspended from a motorized slidable element is described. The controlling device includes a control unit and an inertial platform. The control unit is provided with means to measure and control the speed of the motorized slidable element and is able to process the values representative of the inclination angle of the cable with respect to the vertical to calculate and to impart control actions in order to dynamically control the speed of the motorized slidable element as a function of a desired inclination angle of the cable with respect to the vertical.

12 Claims, 6 Drawing Sheets

(56) References Cited

U.S. PATENT DOCUMENTS

| | | | | |
|---|---|---|---|---|
| 5,909,817 | A * | 6/1999 | Wallace, Jr. | B66C 19/002 212/270 |
| 8,504,253 | B2 * | 8/2013 | Stantchev | B66C 13/063 212/273 |
| 2005/0103738 | A1 | 5/2005 | Recktenwald et al. | |
| 2007/0289931 | A1 | 12/2007 | Henriksson | |
| 2012/0234787 | A1 * | 9/2012 | Ueda | B66C 13/06 212/275 |

FOREIGN PATENT DOCUMENTS

| | | | |
|---|---|---|---|
| FR | 2571867 | A1 | 4/1986 |
| FR | 2704847 | A1 | 11/1994 |
| JP | 11-301969 | * | 11/1999 |
| WO | 2009/030586 | A1 | 3/2009 |
| WO | 2013/041770 | A1 | 3/2013 |

OTHER PUBLICATIONS

Written Opinion for International Application No. PCT/EP2014/073905 filed Nov. 6, 2014 on behalf of Vinati S.R.L. dated Jan. 26, 2015.

International Preliminary Report on Patentability for International Application No. PCT/EP2014/073905 filed Nov. 6, 2014 on behalf of Vinati S.R.L. dated Mar. 30, 2016.

Jaroslaw Smoczek et al.: "Design of gain scheduling anti-sway crane controller using genetic fuzzy system," Methods and Models in Automation and Robotics (MMAR), 2012 17$^{th}$ International Conference on, IEE, Aug. 27, 2012 (Aug. 27, 2012), pp. 573-578, XP032472558, DOI: 10.1109/MMAR.2012.6347822; ISBN: 978-1-4673-2121-1.

Second Office Action for Chinese Patent Application No. 201480064166.8 filed on behalf of Vinati S.R.L. dated Dec. 5, 2017. 8 pages. English Translation + Chinese original.

* cited by examiner

DEVICE AND A PROCESS FOR CONTROLLING A SWINGING OF A LOAD SUSPENDED FROM A LIFTING APPARATUS

CROSS REFERENCE TO RELATED APPLICATIONS

The present application is the US national stage entry of International Patent Application No. PCT/EP2014/073905 filed internationally on Nov. 6, 2014, which, in turn, claims priority to Italian Patent Application No. MI2013A001958 filed on Nov. 25, 2013.

TECHNICAL FIELD

The present invention relates to a device and a process for controlling a swinging of a load suspended by means of cable or chain lifting apparatus, such as bridge cranes, cranes used in construction, motorized cranes and similar apparatus for lifting and moving loads.

BACKGROUND ART

As is known, bridge cranes are machines destined to lift and displace materials and goods, in both external and internal environments, and are generally constituted by a bridge mobile in a horizontal direction along a pair of rails and provided with a cross member on which a carriage is mounted, the carriage housing a hoist that can move horizontally along the cross-member. A winch is connected to the hoist, the winch having a gripping element, for example a hook, for gripping and raising objects.

The winch has one or more cables applied to it, which via a system of hoists, relays and hooks enables lifting and displacing weights.

One of the main problems connected to the use of these plants, as well as in general relating to cable or chain lifting apparatus, is to guarantee the full safety of the operators during the use thereof, also in consideration of the large weights to be moved.

A solution to these problems has been provided by the device described in Italian patents IT 1 386 901 and IT 1 387 564, to which reference is made for further details.

The safety device for lifting apparatus described herein include means for detecting a displacement from the vertical of at least one of the cables which support the gripping element for the load.

An embodiment includes the use of a group of accelerometers, each of the accelerometers being able to determine displacement of the load gripping element on a respective orthogonal Cartesian axis.

In particular, the accelerometers are positioned on the fixed head of the cable, i.e. at the point where the cable supporting the gripping element of the load is fixed and dos not move, i.e. does not slide.

To the detecting means of the displacement from the vertical, acoustic and/or visible warning means, or stop means of the lifting or displacing operations can be associated and able to enter into function if the displacement from the vertical of the cable exceeds at least a predetermined threshold.

A further solution is described in Italian patent IT 1 393 950, to which reference is made for further details.

Briefly, the above document relates to a system enabling integrated management of lifting plants, which system is indicated as Cranes Integrated Management Services (CIMS).

The system enables detecting and cataloguing the data relating to the components of a lifting plant, with the aim of increasing security thereof, for example in order to be able to manage maintenance operations in a way that is clear and simple for the clients.

For example, by means of an accelerometer detecting system located on-board the lifting apparatus data relating to the displacements of the load gripping element, data relating to the displacements of the gripping element of the load on at least an orthogonal Cartesian axis and/or data relating to single events or historical series of events of the lifting apparatus can be detected.

The system enables, among other things, increasing efficiency in managing the maintenance, especially in all those industrial situations where a multiplicity of plants is present.

The data collected can be made available directly on the web without the use of programs installed on the PC, which enables maximum overall accessibility from any Internet station.

However, notwithstanding the fact that the bridge crane is a lifting apparatus subject to specific norms both constructional and relating to periodic checks, the following technical problems remain open, substantially linked to the safety of operators using the apparatus.

One of these problems is given by the fact that the devices of the prior art, though able to determine the displacement of the load with respect to the vertical, perform the determination substantially with the aim of enabling the operator to take the appropriate decisions in a case of excessive displacement. However they do not operate actively to minimize or in any case reduce the swinging of the load during the operations of the bridge crane.

Likewise, though there exist theoretical studies that deal with the problems relating to the swinging of the load in lifting apparatus, the studies are generally based on simulations or laboratory prototypes and generally do not take account of the needs that arise in the industrial field, for example due to the presence of the operator and the commands sent thereby, in respect of the norms and other elements.

A further known device is described in document US 2005/103738, which describes several embodiments of a control system for the swing of a load.

In an exemplary embodiment of such known control system, two inertial platforms are provided.

The first inertial platform is coupled to measure an acceleration of a first object, such as a load, suspended from a second object, such as a trolley, the first inertial platform generating a first signal representing the acceleration of the first object.

The second inertial platform is coupled to measure an acceleration of the second object, the second inertial platform generating a second signal representing the acceleration of the second object.

The device of US 2005/103738 further comprises a processor in communication with the first and the second inertial platform, the processor operable to determine a sway of the first object with respect to the second object based at least in part on the first and second signals, the sway representing a relative displacement of the first object with respect to the second object.

DISCLOSURE OF THE INVENTION

The aim of the present invention is therefore to provide a device and a process for control and stabilization of oscillations of the load, both during the normal operations and due to brusque braking or acceleration steps.

A further aim of the invention is to disclose a device and a procedure for control which is industrially applicable.

A not least aim of the various realisations of the invention is to supply a control procedure of the stability of the bridge crane which exploits the calculation capacity available today.

The aims of the invention are attained with a device for controlling a swinging of a load suspended from a motorized slidable element which can move along a substantially horizontal axis, the controlling device comprising a control unit and an inertial platform, the inertial platform being able to detect representative values of an inclination angle of a cable that supports the load with respect to the vertical and being provided with means for communicating the values to the control unit, wherein the control unit is able to process the values representative of the inclination angle of the cable with respect to the vertical so as to calculate and to impart control actions in order to dynamically the speed of the motorized slidable element as a function of a desired inclination angle of the cable with respect to the vertical.

An advantago of this embodiment is that it enables operating on the sliding element of the lifting apparatus contemporaneously with the loading movements, with the aim of reducing the swinging and maintaining the load suspended as far as possible near to a desired position.

In a further embodiment of the invention, the inertial platform is able to detect the oscillating angles of the load with respect to the vertical in two reciprocally perpendicular oscillation angles defining sliding axes for respective motorized sliding elements of the lifting apparatus and the control unit is able to process the values with the aim of calculating and imparting motor control actions with the aim of minimizing the swinging of the load.

An advantage of this embodiment is that it enables working at the same time on sliding elements operating in mutually perpendicular directions such as, for example, in the case of a bridge crane, the carriage and the bridge, so as to reduce the swinging of the suspended load and maintain it as close as possible to a desired spatial position.

In a further embodiment of the invention, the inertial platform comprises an accelerometer and a gyroscope.

An advantage of this realization is that it enables detecting information on the position of the load and, by combining the readings of the accelerometer with those of the gyroscope, measuring the oscillation angle of the load with the algebraic sign thereof, with the aim of precisely determining the position of the load, as well as calculating the dynamic parameters such as, for example, the velocity and the angular acceleration.

In a further embodiment of the invention, the inertial platform is positioned at a fixed head of a cable or of a chain which supports a load gripping element.

An advantage of this embodiment is that it enables a precise measuring of the physical values measured by the inertial platform, the position not being influenced by movements of the organs of the lifting apparatus, such as for example those of the pulleys freely slidable on the respective cables.

In a further embodiment of the invention, a remote processing unit can be associated to the control unit.

An advantage of this embodiment is that by means of the use of the remote processing unit it enables using the data processed by the control unit by means of a system control and configuration software, as well as a post-processing program, and to interface with the CIMS platform, and interface with other data processing systems, for example PLC, PC, and the like.

The invention further comprises a lifting apparatus comprising an inertial platform associable to the control device able to act on the lifting apparatus.

A further embodiment of the present invention relates to a process for control of swing of a suspended load by means of a lifting apparatus, wherein the following steps are comprised:

- monitoring a representative value of an inclination angle of a cable that supports the load with respect to the vertical;
- determining a difference between the monitored inclination angle and a desired inclination angle so as to reduce or eliminate the difference;
- calculating the action of control to be applied to at least one of the motors of the motorized slidable elements;
- applying the control action to at least one of the motors of the motorized slidable elements as a function of a desired inclination angle of the cable with respect to the vertical.

In a further embodiment of the invention, the step of calculating the control action is carried out by taking account of the variations of the distance of the load from the sliding element of the lifting apparatus.

An advantage of this embodiment is given by the fact that it enables operating on all the lifting apparatus in which the load can be subject to considerable excursions, passing from a lowered position to a raised position, for example by means of the effect of a hoist or winch able to raise or lower a load.

In a further embodiment of the invention, wherein the step of calculating the step of application of the calculated control action are carried out independently for each of the activations of the sliding elements if the lifting apparatus.

An advantage of this solution is that it enables simplification of both the calculation of the control action, and the practical implementation thereof.

The various aspects of the process can be actuator with the aid of a computer program comprising a source code which implements the steps of the process. The computer program can be memorized, for example, in a memory associated to the control unit.

BRIEF DESCRIPTION OF THE DRAWINGS

Further characteristics and advantages of the invention will emerge from a reading of the description that follows, provided by way of non-limiting example, with the aid of the figures of the accompanying drawings.

DESCRIPTION OF THE DRAWINGS

The present invention relates to a device and a procedure for controlling oscillation of a load suspended by means of cable or chain lifting equipment, such as bridge cranes, tower cranes for construction, mobile cranes and similar apparatus for lifting and moving loads. For the sake of simplicity, it will be described with reference to a bridge crane.

Figure 1:
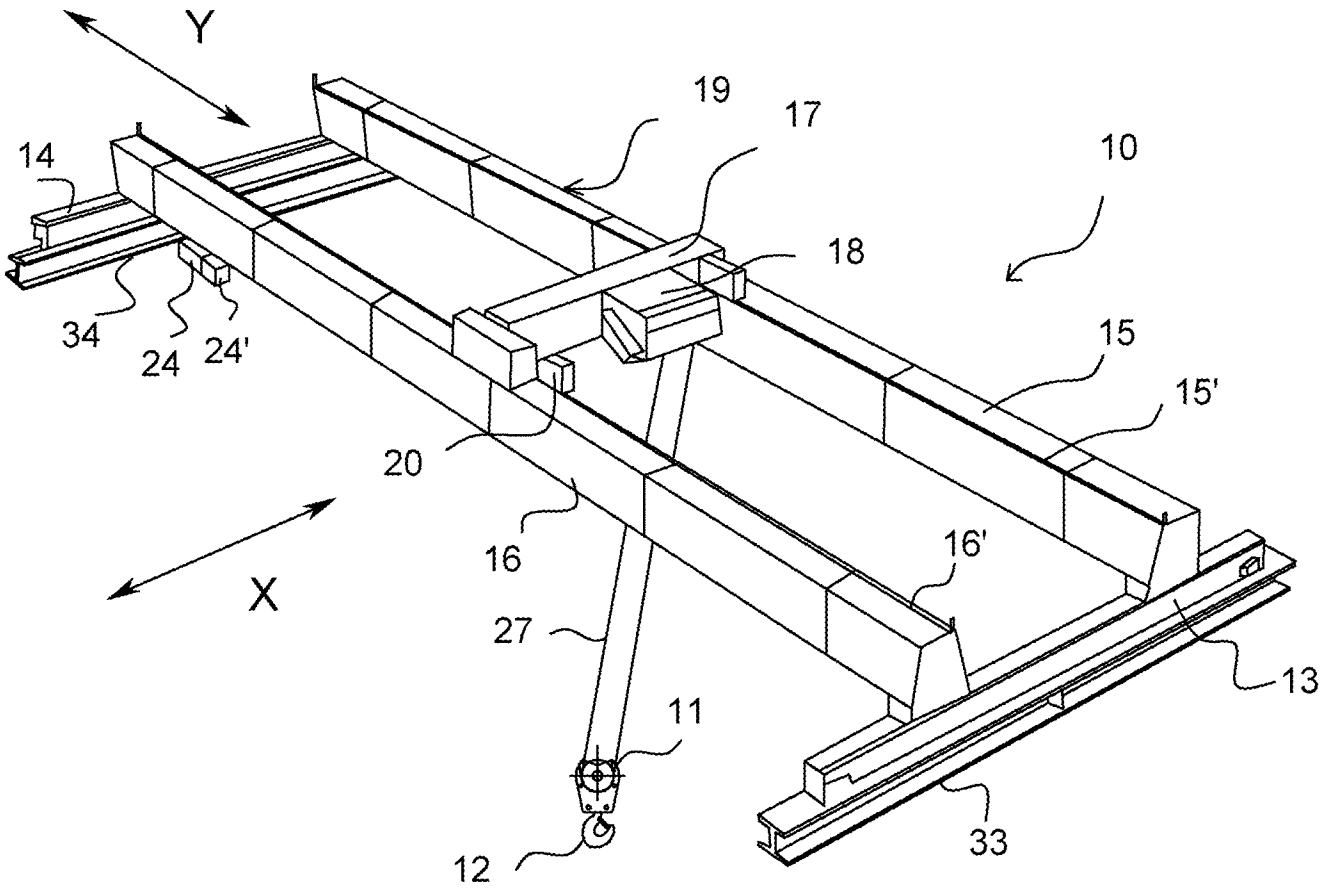
FIG. 1 is a perspective view of a bridge crane to which the control device is applied according to an embodiment of the present invention.

FIG. 1 schematically illustrates a bridge crane 10 exhibiting a bridge 19 comprising two mutually parallel beams 15,16, the bridge 19 being mobile along a first direction denoted in FIG. 1 by X, which movement is achieved by the movement of the two heads 13,14 along two beams 33,34.

A motorized carriage 20 is mounted on the bridge 19, which carriage can slide on two rails 15', 16', each located on a respective beam 15, 16 of the bridge 19. The carriage 20 can slide along a perpendicular direction to the first direction X, denoted by Y.

The bridge 19 is associated with a motor 24, equipped with an inverter 24', which enables it to move along the X axis of FIG. 1, while the motorized carriage 20 is associated to a relative motor (not shown for the sake of simplicity), also equipped with a respective inverter.

As illustrated in greater detail in the following, a control device is associated to the bridge crane, which control device includes a control unit 40 for imparting control actions to the motors of the bridge crane, and commanding (for each motor) a respective inverter which regulates the velocity of the engine to which it is associated.

In a variant of the invention, the control unit 40 can command via a PLC (Programmable Logic Controller) or another control unit, which in turn acts on the inverters of the motors.

A pulley 11 is associated to the carriage 20, which pulley is in turn provided with a gripping element 12, for example a hook, and can raise or lower a load (not shown for the sake of simplicity) using a system of cables 27 operated by a hoist 18 mounted on the cross member 17.

The gripping element of the load 12 can thus be raised or lowered along a vertical direction, but can also be subject to movements in which the load 12 deviates from the vertical, depending on working conditions, for example when the bridge 19 and/or the carriage 20 are in motion, or when a force is applied by an operator.

Figure 2:
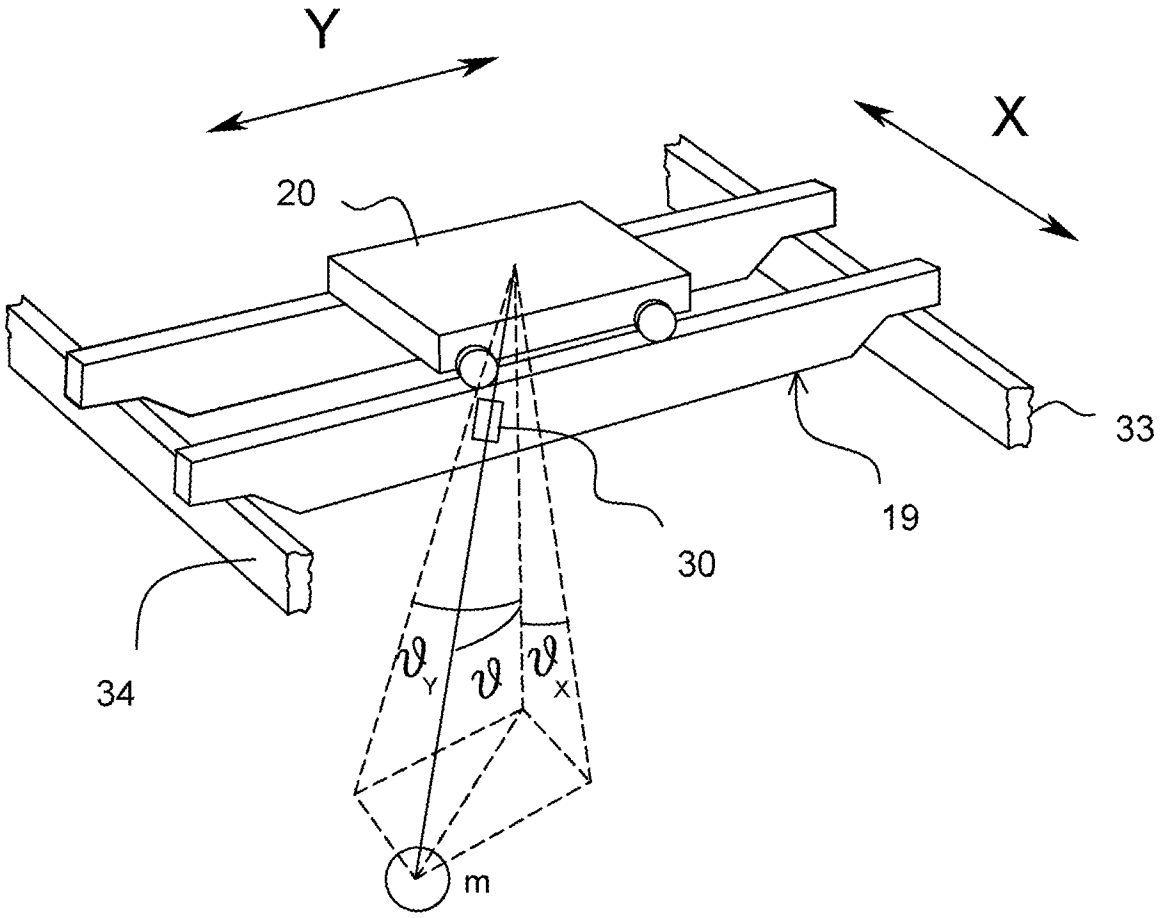
FIG. 2 is a schematic view of the bridge crane of FIG. 1.

In FIG. 2 the crane of FIG. 1 is represented in terms of its main components, so as to highlight an inertial platform 30 able tb measure the movements of the cable bearing the gripping element of the load, as illustrated in the following description.

A device for the active control of stability according to the various embodiments of the present invention is also associated to the bridge crane 10.

Figure 3:
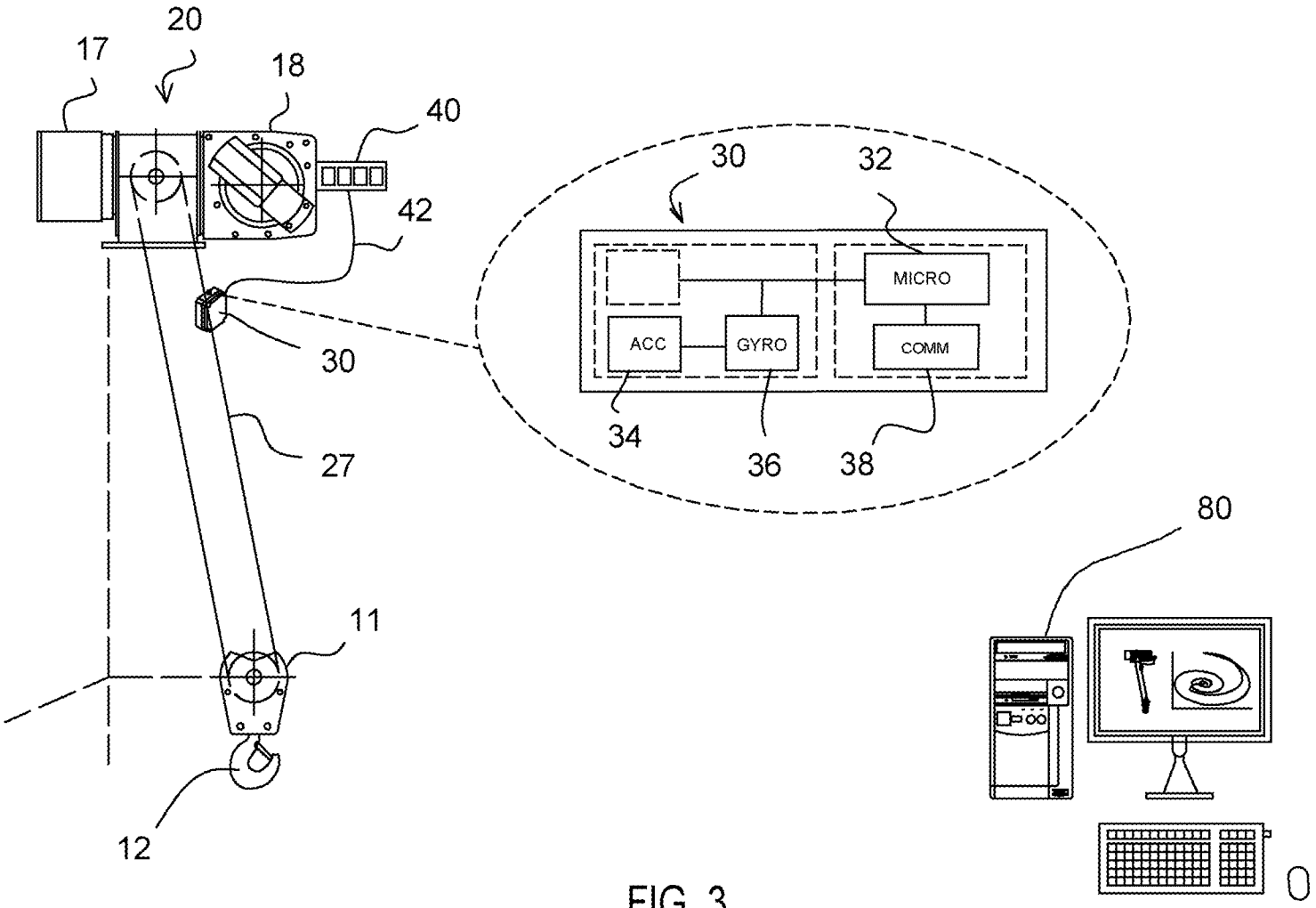
FIG. 3 is a schematic view of embodiments of the control device of the invention.

With reference to FIG. 3, note that the control device comprises the inertial platform 30 and the control unit 40, the control unit being able to impart motion commands to the inverters that control the activation of the bridge crane motors.

The control unit 40 can then issue commands both to the inverter 24' which adjusts the motor 24 activating the movement of the bridge 19, and to the inverter regulating the motor that drives the movement of the carriage 20; these commands are mutually independent and can be sent to the inverters of the motors by means of an analog, canbus or other ethernet bus connections.

In particular, the inertial platform 30 comprises a three-axis accelerometer 34 and a gyroscope 36, both being manageable by a microprocessor 32.

In a preferred embodiment the control unit 40 can be mounted on the actual bridge crane (as indicated in the left part of FIG. 3) and be connected by cable 42, or in wireless mode, to the inertial platform 30.

In another preferred embodiment the control unit 40 can be associated to the remote control unit, for example incorporated in a server 80, where the remote unit can operate control and system configuration software, as well as data post-processing software and can interface with a Cranes Integrated Management Services (CIMS) type platform as described in patent IT 1 393 950, which is incorporated herein for reference purposes.

In a variant of the invention, the inertial platform 30 and the control unit 40 can be integrated in a single unit.

With reference now to the inertial platform 30, the three-axis accelerometer 34 is capable of measuring the angle of inclination of the cable 27 which supports the gripping element of the load 12; however the angle measured only indicates the inclination of the cable relative to the vertical, but does not contain the information relative to the direction in which the cable is inclined.

In order to complete the representation in space of the movements of the gripping member 12, the inertial platform 30 also includes a gyroscope 36.

As known, the gyroscope 36 is an instrument that tends to maintain the axis of rotation thereof orientated in a fixed direction and thus enables measuring an angle of orientation with respect to the fixed direction.

Therefore the combination of the information derived from the measurements made by the three-axis accelerometer 34 and the gyroscope 36 is used to determine the position of the gripping element 12 in the space, as expressed for example by the angle $\vartheta$ of FIG. 2, as well as to calculate the change over time $\dot{\vartheta}$ of the angle as well as the angular acceleration $\ddot{\vartheta}$.

In a preferred embodiment of the invention, the inertial platform is placed on the fixed head of the cable supporting the gripping element.

This arrangement of the inertial platform is preferable to a positioning of the inertial platform on the pulley 11, in that the pulley 11 is free Lo slide on the cables 27 and the gripping element has a tendency always to maintain a substantially vertical orientation. Therefore an accelerometer on the pulley would have the tendency of measuring accelerations considerably smaller than the accelerations measured when it is placed on the cable head.

In any case, the data from the inertial platform 30 are sent to the control unit 40 to allow the control device to identify the corrections that must be provided to the carriage 20 and the bridge 19. These corrections are then activated by operating on the inverters of the respective drive motors in order to move the carriage 20 and/or the bridge 19 so as to bring the gripping element of the load into a vertical position, or to a desired angle, in a shorter time than that in which no control is present.

The control device can also act in conjunction with the movement of the bridge and/or carriage to keep the angle of inclination of the cable within small values that allow for safe operation.

Figure 4:
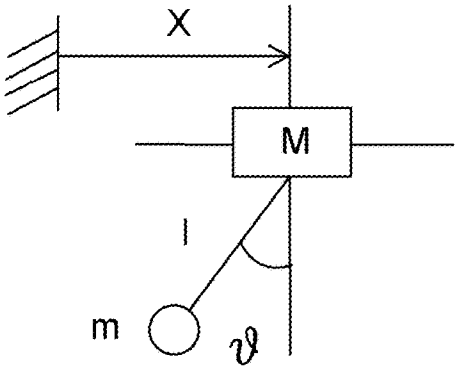
FIG. 4 is a schematic view of some relevant parameters for the control system of the invention.

In order to illustrate the functioning of the control system, reference is now made to FIG. 4, which is a schematic view of some relevant parameters for the system, illustrated according to an example that considers only the horizontal movement of one of the components of the crane.

As the bridge crane can include a movement of the carriage 20 along a first axis and another movement, given by the bridge 19, along a second axis perpendicular to the first, all the concepts that follow can be applied on both axes.

Since, however, the motions of these axes are decoupled from one another as they are generated by respective motors, operable independently of one another, for reasons of simplicity reference can be made to a casc of movement along ori axis alone, i.e. in the present example the X-axis shown in FIG. 4, with the movement along the second axis being schematized and controllable independently and in an entirely similar way.

Therefore, one of the components of the bridge crane, which can be the carriage 20 or the bridge 19, is shown schematically as an example in FIG. 4, indicating the mass M and its position X, i.e. the distance of the centre of gravity of the mass M from a fixed reference. The mass M can move along the axis X.

A weight m is constrained to the mass M by a cable or chain having a length 1. The weight m can therefore oscillate like a simple pendulum and can therefore deviate from the vertical by an angle $\vartheta$.

The weight m thus indicates the weight that the crane has to lift, where, depending on individual cases, the weight can be given by the weight of the gripping element supporting the load or the unloaded gripping element. The logic of the system remains the same in both cases.

Therefore, to build a model of the dynamic performance of the system illustrated in FIG. 4, the following procedure can be employed.

Firstly the Lagrangian function L of the system of FIG. 4 can be defined:

$$L=T-U$$

where, as is known, T is the kinetic energy of the system and U the potential energy thereof.

For the system illustrated in FIG. 4, using the generalized Lagrange coordinates, the following equations can be written:

$$T=\tfrac{1}{2}(M+m)\dot{x}^2+\tfrac{1}{2}\,ml^2\dot{\vartheta}^2+ml\dot{\vartheta}\dot{x}\cos\vartheta$$

and $$U=mgl(1-\cos\vartheta)$$

where $\dot{x}$ is the velocity along the axis X and $\dot{\vartheta}$ is the angular velocity of the pendulum with length l and mass m.

In this case it has been assumed that the cable has a constant length of 1 and a weight that can be considered irrelevant.

With this premise the Euler-Lagrange equations for the system of FIG. 4 can be written, i.e:

$$\frac{d}{dt}\frac{\partial L}{\partial\dot{\vartheta}}-\frac{\partial L}{\partial\vartheta}=-b\dot{\vartheta}$$

$$\frac{d}{dt}\frac{\partial L}{\partial\dot{x}}-\frac{\partial L}{\partial x}=F$$

where b is a parameter representing the frictions and F is a force applied to the system.

Following the calculations, the following equations result:

$$\frac{d}{dt}\frac{\partial L}{\partial\dot{\vartheta}}-\frac{\partial L}{\partial\vartheta}=ml^2\ddot{\vartheta}+ml\ddot{x}\cos\vartheta+mgl\sin\vartheta=-b\dot{\vartheta}$$

$$\frac{d}{dt}\frac{\partial L}{\partial\dot{x}}-\frac{\partial L}{\partial x}=(M+m)\ddot{x}+ml\left(\ddot{\vartheta}\cos\vartheta-\dot{\vartheta}^2\sin\vartheta\right)=F$$

Using the reference velocity $\dot{x}_{ref}$ of the motor displacing the mass M along the axis X of FIG. 4 as a control variable, and, with the hypothesis that the control of the velocity is rapid and accurate, the following can be posited: $\ddot{x}\cong\dot{x}_{ref}$.

Defining the control action as $u\cong\ddot{x}_{ref}$ and linearizing with the condition $\dot{\vartheta}=\vartheta=u=0$, a dynamic model is obtained, defined by the equation (1), which represents the relation between the control action u and the dynamic parameters defining the position, the velocity and the acceleration of the mass m, i.e:

$$\ddot{\vartheta}(t)+\frac{b}{ml^2}\dot{\vartheta}(t)+\frac{g}{l}\vartheta(t)+\frac{1}{l}u(t)=0 \tag{1}$$

Figure 5:
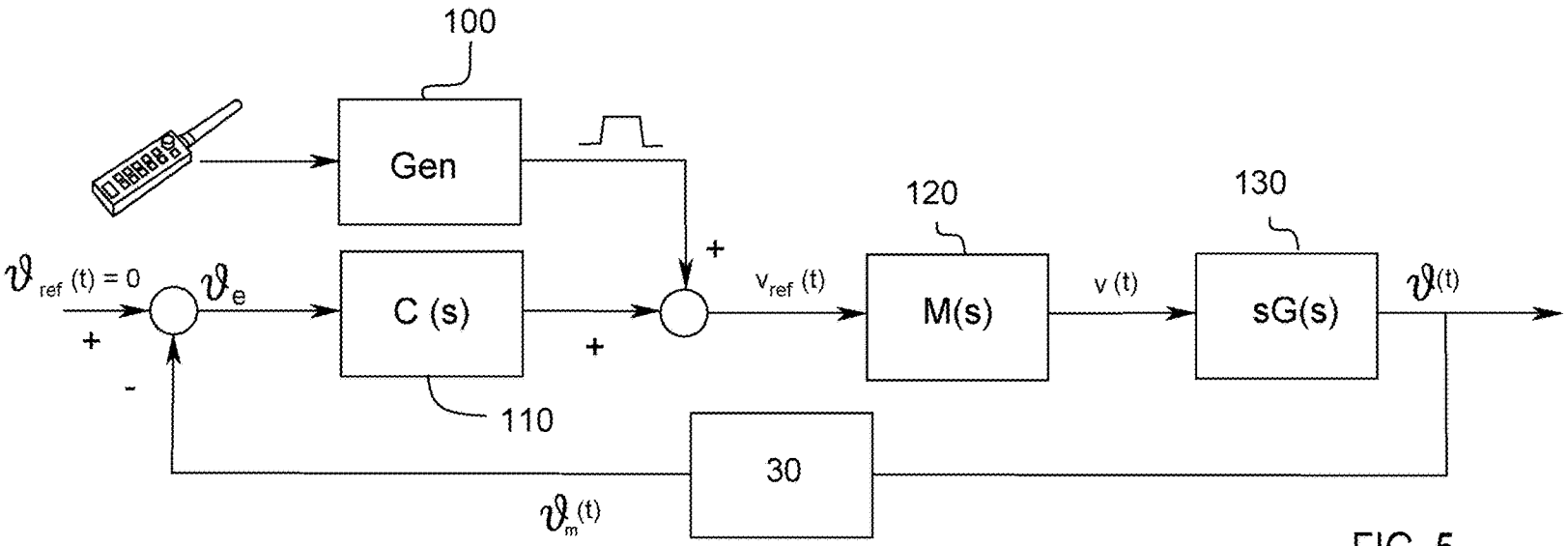
FIG. 5 illustrates a block diagram relating to the architecture of an embodiment of the control system.

With reference to FIG. 5, the block diagram relating to an embodiment of the control system of the invention is described.

In particular, in the hypothesis that the load gripping element is to be brought into the vertical position, i.e. attaining $\vartheta_{ref}(t)=0$, in the block diagram of FIG. 5 the controller C(s) (block 110) and the possible inputs of a bridge crane operator (block 100) are indicated.

The controller C(s) receives as input the angular error $\vartheta_e$, given by the difference between the desired angle $\vartheta_{ref}(t)$ and the angle measured by the inertial platform 30, i.e. $\vartheta_m(t)$.

The controller C(s), on the basis of the angular error $\vartheta_s$, calculates the reference or desired velocity $v_{ref}(t)$ to be set to the carriage aiming to reduce or eliminate the angular error $\vartheta_s$.

The control system also includes the consideration of the eventual inputs of an operator of the bridge crane (block 100), if present.

The reference or desired velocity $v_{ref}(t)$ translates into an effective velocity v(t) of the carriage by effect of the relative inverter-controlled motor, which effect includes the internal mechanisms of the motor and which is schematized by the transfer function M (s) of the block 120. In many cases, for the sake of simplicity, M (s)~1 can be posited.

In turn the effective velocity v(t) of the carriage is used as an input for the dynamic model of the bridge crane (Eq. (1)) which supplies in output the effective angle $\vartheta$ (t) assumed by the cable bearing the load gripping element.

This angle can be measured by the inertial platform 30 which returns a value $\vartheta_m(t)$ to be used for calculating a new value of the angular error $\vartheta_s$.

The controller C (s) can be proportional, i.e. C (s)=$K_p$, where the gain $K_p$ links the angular error to the reference velocity $v_{ref}(t)$ for piloting the motors.

The effective value of $K_p$ to be applied depends on the system. In general with high $K_p$ there is a rapid reduction in swing, though with a cost in terms of reduction of velocity of the carriage and vice versa.

Further, to improve the performance of the system a further consideration must be the variation in length of the cable, account of which can be taken by a gain scheduled proportional controller, described in more detail in the following.

Alternatively, the controller C (s) can be a PI controller, i.e. a proportional-integral controller.

The functioning of the control system is entirely alike when an inclination is required of the gripping element of the load that is not the vertical, for example a degree during the movement of the whole bridge crane from one position to another on the work site. The only difference will be setting a different desired inclination, i.e. in the example $\vartheta_{ref}(t)=1°$.

Figure 6:
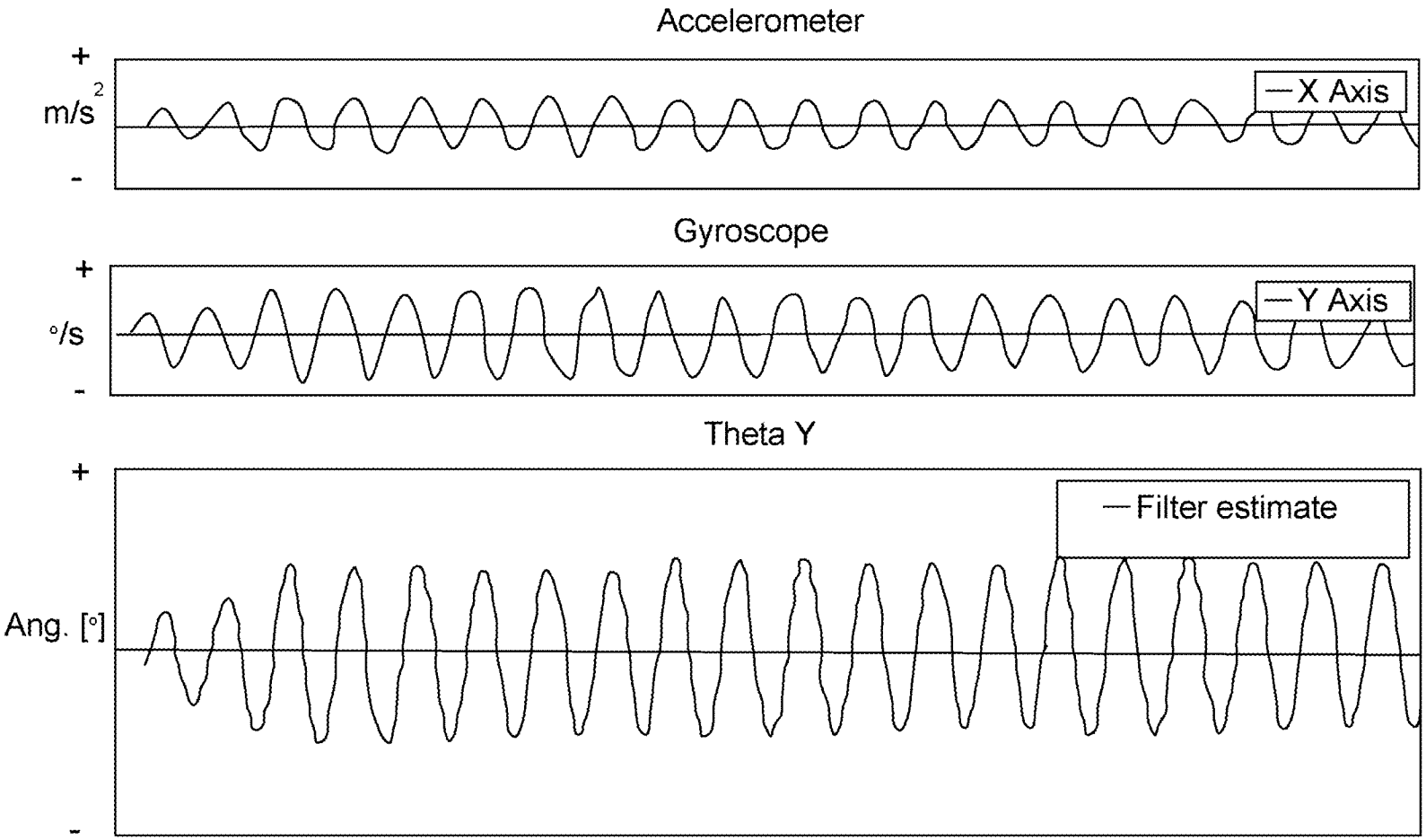
FIG. 6 illustrates a measuring element of the parameters describing the motion of a load.

FIG. 6 illustrates a measuring example of the parameters describing the motion of the gripping element carried out using the inertial platform 30.

In this case a first measurement can be taken by the accelerometer which measures, in the described case, the variation in acceleration of the load along axis Y. At the same time the gyroscope 36 can measure a variation in the attitude angle of the load along axis X.

The measurements can be combined by means of known filtering methods, for example with the use of an extended Kalman filter, with the aim of obtaining a measurement of the variation of the angle $\vartheta$ along the axis Y with the algebraic sign thereof.

Figure 7:
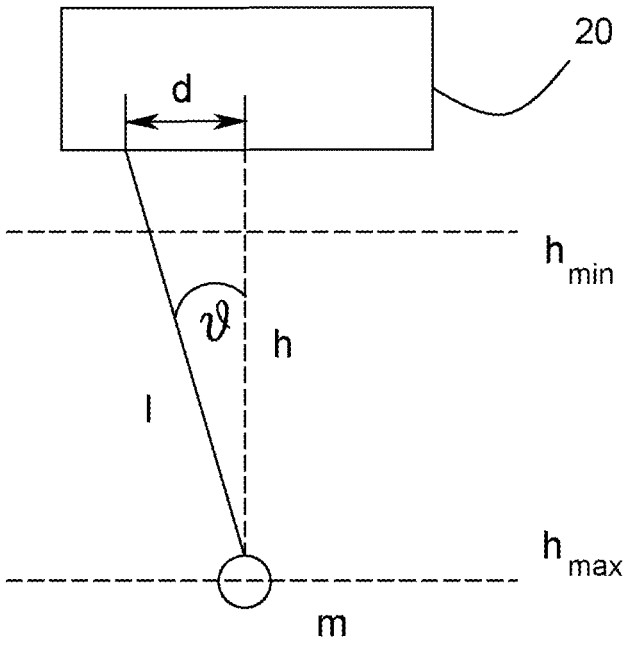
FIG. 7 is a schematic view, in a single dimension, of some relevant parameters for the control system of the invention.

To refine the performance of the control system, the gain $K_p$ of the controller can be considered to depend also on the distance 1 of the load from the carriage, as is schematically illustrated in FIG. 7.

In this case a gain scheduled proportional controller can be used in operation.

As is known, the gain scheduled control method implicates designing a controller for various functioning points of the system to be controlled. The parameters obtained in this way can then be interpolated in such a way as to design a controller which has a variable gain depending on the various functioning points.

FIG. 7 illustrates, by way of example, a carriage 20 which displaces on the rails and a load of a mass m connected to the carriage by means of cables or chains which are considered to have an insignificant mass.

The variables required for gain scheduling control are:

- the distance d between the hook of the head and the axis formed between the carriage and the load in stationary conditions (without oscillations),
- the angle $\vartheta$ of oscillation, estimated using the inertial platform, which is equal to the inclination angle of the cable that supports the load,
- and the range $h_{max}$ and $h_{min}$ within which the mass m can move along the vertical axis.

Figure 8:
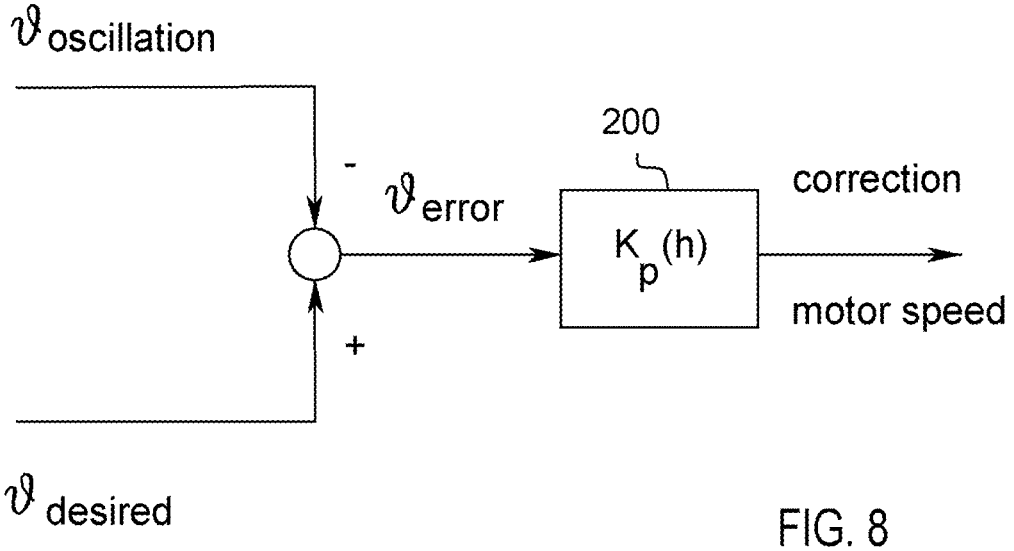
FIG. 8 illustrates a block diagram relating to the architecture of a further embodiment of the control system.

FIG. 8 schematizes the functioning of the proportional controller. The angle of oscillation is obtained by the inertial platform and filtered with a high-pass filter so as to eliminate the continuous component, while the desired angle is zero, i.e. no oscillation at all. The difference error obtained is multiplied by a coefficient $K_p(h)$ depending on the height h of the load so as to obtain the correction of the velocity to be sent to the inverters which command the motors.

Starting from the available data the height of the load is estimated (understood as being the distance from the carriage) with the objective of scheduling the control gain:

$$\ell = \frac{d}{\sin\vartheta}$$

$$h = \sqrt{\ell^2 - d^2}$$

At this point h is estimated and is saturated between h_max and h_min, i.e. in such a way that h is always comprised between these values.

From an initial system setting step, the two values $K_p$ to be applied at the maximum and minimum heights can be obtained, i.e. $K_{p_max}$ and $K_{p_min}$. At this point, to calculate the value of $K_p$ the following formula can be used:

$$K_p(h) = K_{p_min} + (K_{p_max} - K_{p_min}) * \frac{h - h_{min}}{h_{max} - h_{min}}$$

This solution enables opeiaLirig in all cases where the load is subject to significant excursions, passing from a lowered position to a raised position, for example by effect of the hoist 18.

Lastly, in general, by locating the control unit in a remote position with respect to the lifting apparatus, apart from remote control operation, the apparatus can be integrated with a real-time data collection with the purpose of controlling the functioning of the lifting operation and the planning of its maintenance.

The invention as it is conceived is susceptible to numerous modifications and variants, all falling within the scope of the inventive concept. Further, all the details can be replaced by other technically-equivalent elements.

The invention claimed is:

1. A device for controlling a swinging of a load suspended from a motorized slidable element which can move along a substantially horizontal axis, the controlling device comprising a control unit and an inertial platform, the inertial platform being able to detect representative values of an inclination angle of a cable that supports the load with respect to the vertical and being provided with means for communicating the values to the control unit, wherein the control unit is provided with means to measure and control the speed of the motorized slidable element and is able to process the values representative of the inclination angle of the cable with respect to the vertical so as to calculate and to impart control actions in order to dynamically control the speed of the motorized slidable element as a function of a desired inclination angle of the cable with respect to the vertical and wherein the control unit comprises a gain scheduled proportional controller provided with means to calculate a variable gain to be applied to the control of the speed of the motorized slidable element as a function of a distance of the load from the motorized slidable element, the distance being comprised between a maximum and a minimum value, the variable gain being calculated as a function of the distance of the load from the motorized slidable element.

2. The device of claim 1, wherein the inertial platform is able to detect the inclination angles of the cable that supports the load with respect to the vertical in two reciprocally perpendicular oscillation directions defining sliding axes for respective motorized sliding elements and the control unit is able to process the values with the aim of calculating and imparting motor control actions as a function of a desired inclination angle of the cable with respect to the vertical.

3. The device of claim 1, wherein the control unit imparts the calculated control actions to the motors by commanding, for each motor, a respective inverter which regulates the velocity of the motor to which it is associated.

4. The device of claim 1, wherein the inertial platform comprises an accelerometer and a gyroscope.

5. The device of claim 1, wherein the inertial platform is positioned at a fixed head of the cable which supports a load gripping element.

6. The device of claim 1, wherein a remote processing unit can be associated to the control unit.

7. A process for control of swing of a suspended load by means of motorized slidable elements, comprising the following steps:

monitoring a representative value of an inclination angle of a cable that supports the load with respect to the vertical;

determining a difference between the monitored inclination angle and a desired inclination angle so as to reduce or eliminate the difference;

calculating the action of control to be applied to at least one of the motors of the motorized slidable elements;

applying the control action to at least one of the motors of the motorized slidable elements as a function of a desired inclination angle of the cable with respect to the vertical; and calculating a variable gain to be applied to the control of the speed of the motorized slidable element as a function of a distance of the load from the motorized slidable element, the distance being comprised between a maximum and a minimum value, wherein the calculation is performed by means of a gain scheduled proportional controller and wherein the variable gain is calculated as a function of the distance of the load from the motorized slidable element.

8. The process of claim 7, wherein the step of monitoring a value representing the inclination angle is done with the use of an inertial platform.

9. The process of claim 7, wherein the step of calculating the control action to be applied to at least one of the motors of the motorized slidable elements is carried out on the basis of a mathematical model which takes account of the representative value of the monitored inclination angle and the variation thereof over time.

10. The process of claim 7, wherein the calculating step of the control action is carried out taking account of variations in the distance of the load from the sliding element.

11. The process of claim 7, wherein the calculating step and the applying step of the calculated control action are carried out independently for each of the motors of the sliding elements, by commanding respective inverters.

12. A control apparatus for a lifting apparatus comprising a control unit, a memory and a computer program, stored in the memory, the computer program carrying out, when executed, the process of claim 7.

* * * * *